US007404214B2

(12) United States Patent
Woolcott et al.

(10) Patent No.: US 7,404,214 B2
(45) Date of Patent: Jul. 29, 2008

(54) POWDER SKIRT ZIPPER SYSTEM

(75) Inventors: Richard Woolcott, Laguna Beach, CA (US); Abran Abeyta, Newport Beach, CA (US); Arriana Padron, Laguna Beach, CA (US); Jay Twitty, Dana Point, CA (US); William Anderson, Mammoth Lakes, CA (US)

(73) Assignee: Volcom, Inc., Costa Mesa, CA (US)

( * ) Notice: Subject to any disclaimer, the term of this patent is extended or adjusted under 35 U.S.C. 154(b) by 0 days.

(21) Appl. No.: 10/984,074

(22) Filed: Nov. 8, 2004

(65) Prior Publication Data

US 2005/0114979 A1 Jun. 2, 2005

Related U.S. Application Data

(60) Provisional application No. 60/518,120, filed on Nov. 6, 2003.

(51) Int. Cl.
*A41D 3/02* (2006.01)

(52) U.S. Cl. ..... 2/85; 2/87; 2/93

(58) Field of Classification Search ..... 2/2.12, 2/2.17, 69, 69.5, 70–72, 75, 76, 78.4, 80, 2/85–96, 108, 232, 227, 229, 236, 237
See application file for complete search history.

(56) References Cited

U.S. PATENT DOCUMENTS

| | | | | |
|---|---|---|---|---|
| 1,298,043 | A * | 3/1919 | Hollander | 2/70 |
| 1,476,831 | A * | 12/1923 | Pease | 2/70 |
| 1,479,854 | A * | 1/1924 | Heller | 2/79 |
| 1,659,451 | A | 2/1928 | Sweeney | |
| 2,130,690 | A * | 9/1938 | Lemoine | 2/70 |
| 2,152,575 | A * | 3/1939 | Urbon | 2/70 |
| 2,164,683 | A | 7/1939 | Kessler | |
| 2,216,852 | A * | 10/1940 | McMeekin | 2/270 |
| 2,242,365 | A | 5/1941 | Muhr | |
| 2,390,462 | A | 12/1945 | Rosenberg | |

(Continued)

FOREIGN PATENT DOCUMENTS

DE 32 28 720 A1 2/1984

(Continued)

OTHER PUBLICATIONS

Patagonia Catalog Fall 1997, Nitro II Jacket & Pant p. 14.*

*Primary Examiner*—Alissa L Hoey
(74) *Attorney, Agent, or Firm*—Kauth, Pomeroy, Peck & Bailey LLP

(57) ABSTRACT

Garments and garment sets are described that include a jacket having a powder skirt and trousers that can be attached to the powder skirt via at least one fastener. One embodiment of the invention includes a water resistant jacket, an elasticized powder skirt having at least two edges, the first of which is attached to the water resistant jacket, at least one fastener connected to the second edge of the powder skirt, water resistant trousers including a waist opening and two leg openings and at least one corresponding mating fastener connected to the trousers. The fastener and the corresponding mating fastener are constructed to detachably fix the powder skirt to the water resistant trousers. In several embodiments, the fastener and corresponding mating fastener are two mating zipper portions of standard length that can be combined to form a zipper irrespective of the garment size.

11 Claims, 5 Drawing Sheets

U.S. PATENT DOCUMENTS

| | | | | | |
|---|---|---|---|---|---|
| 2,465,286 | A | * | 3/1949 | Silversteen | 2/51 |
| 2,562,234 | A | | 7/1951 | Gottschalk | |
| 3,312,982 | A | * | 4/1967 | Pitman | 2/232 |
| 3,389,407 | A | * | 6/1968 | Morrison | 2/84 |
| 3,733,615 | A | * | 5/1973 | Jaffee | 2/232 |
| 3,737,916 | A | * | 6/1973 | Grenier | 2/70 |
| 3,921,224 | A | * | 11/1975 | Ingram, III | 2/93 |
| 3,965,487 | A | * | 6/1976 | Mazur | 2/69.5 |
| 4,017,910 | A | * | 4/1977 | Bente | 2/232 |
| 4,773,100 | A | * | 9/1988 | Kuo | 2/46 |
| 4,987,610 | A | * | 1/1991 | Hunt | 2/46 |
| 4,993,077 | A | * | 2/1991 | Robison | 2/82 |
| 5,182,812 | A | | 2/1993 | Goldsby | |
| 5,343,564 | A | * | 9/1994 | Reynolds et al. | 2/70 |
| 5,794,268 | A | * | 8/1998 | Pessey | 2/227 |
| 6,108,815 | A | | 8/2000 | Majerfeld | |
| 6,185,745 | B1 | * | 2/2001 | Alger | 2/107 |
| 6,389,600 | B1 | * | 5/2002 | Di Maio | 2/121 |
| 6,665,878 | B1 | * | 12/2003 | Way | 2/84 |
| 2005/0022285 | A1 | * | 2/2005 | Berns et al. | 2/69 |
| 2005/0044605 | A1 | * | 3/2005 | Hofmann | 2/69 |
| 2005/0166300 | A1 | * | 8/2005 | Tanaka | 2/108 |

FOREIGN PATENT DOCUMENTS

| | | | |
|---|---|---|---|
| FR | 002559652 | A1 | 8/1985 |
| FR | 002803177 | A3 | 7/2001 |
| JP | 410037010 | A | 2/1998 |

* cited by examiner

POWDER SKIRT ZIPPER SYSTEM

CROSS-REFERENCE TO RELATED APPLICATION

This application claims priority on U.S. provisional application No. 60/518,120, filed on Nov. 6, 2003, the content of which is incorporated herein by reference.

BACKGROUND OF THE INVENTION

Numerous winter sports are performed outdoors in snow conditions. Skiing and snowboarding are examples of two such sports. Falling in snow is a hazard of many winter sports. Therefore, a variety of garments have been developed to keep participants as warm and dry as possible.

During a fall, snow will often work its way inside waterproof garments through openings in the garment. Where a separate jacket and trousers are worn, snow can often work its way inside the jacket through the opening in the base of the jacket. Snow can be prevented from finding its way inside a jacket by using an inner skirt of water resistant material inside and near the base of the jacket, referred to as a "powder skirt." The skirt is typically elasticized in order to hug the waist of the wearer and form a barrier extending from the trousers to the inside lining of the jacket.

SUMMARY OF THE INVENTION

A garment set is disclosed that includes a jacket and a pair of trousers, where the jacket includes a powder skirt that can attach to the trousers. In one aspect of the invention the jacket is attached to the trousers via a zipper, and the zipper is standardized so that a jacket in accordance with the present invention can be used in conjunction with a variety of different sized trousers. In another aspect, the mating portion of the zipper on the trousers can be at least partially concealed beneath a welt flap when not attached. One embodiment of the invention includes a water resistant jacket, an elasticized powder skirt having at least two edges, the first of which is attached to the water resistant jacket, at least one fastener connected to the second edge of the powder skirt, water resistant trousers including a waist opening and two leg openings and at least one corresponding mating fastener connected to the trousers. The fastener and the corresponding mating fastener are constructed to detachably fix the powder skirt to the water resistant trousers.

In a further embodiment, the fastener is a mating portion of a zipper, the corresponding mating fastener is a corresponding mating portion of a zipper and the mating portion of a zipper and the corresponding mating portion of a zipper are constructed to combine to form a zipper.

In another embodiment, the water resistant jacket includes an interior surface and an exterior surface and the first edge of the powder skirt is attached to the interior surface of the jacket.

In a further embodiment again, the first edge of the powder skirt is stitched to the interior surface of the jacket.

In yet another embodiment, the water resistant trousers include an interior surface and an exterior surface and the at least one corresponding mating fastener is attached to the exterior surface of the trousers.

In a still further embodiment, the corresponding mating fastener is a mating portion of a zipper that is permanently attached to the trousers.

In still another embodiment, the water resistant trousers include two powder skirts, each powder skirt is attached to the interior surface of the trousers and each powder skirt extends at least partially from one of the trouser leg openings.

In a still further embodiment again, the water resistant jacket and water resistant trousers are constructed from materials having water resistance and thermal insulation sufficient to perform activity in snow conditions.

In still yet another embodiment, the powder skirt is attached to the water resistant jacket and the trousers with sufficient strength to act as a barrier to water and snow in the event of a fall by the wearer in snow conditions.

Another aspect of the invention includes an interior surface and an exterior surface, an elasticized powder skirt having at least two edges, the first of which is attached to the jacket and at least one standard fastener connected to the powder skirt. In addition, the powder skirt can be attached to the interior surface of the jacket. Furthermore, the fastener can be a mating zipper portion of a standard length that is attached to the second edge of the powder skirt.

An additional further embodiment is constructed from at least one material having water resistance and thermal insulation sufficient for use in snow conditions.

Another aspect of the invention again includes a waist opening, two leg openings, an interior surface and an exterior surface and at least one fastener permanently attached to the trousers. The fastener is of a type and located to combine with corresponding fasteners on any of a number of different sized jackets. In addition, the fastener can be attached to the exterior surface of the trousers. Furthermore, the fastener can be a mating portion of a zipper of a predetermined standard length.

In another additional embodiment, the mating portion of a zipper is at least partially concealed beneath a welt flap.

A still further additional embodiment includes two powder skirts, where each powder skirt is attached to the interior surface of the trousers and each powder skirt is located at least partially within the trouser leg openings.

In another additional embodiment again, the trousers are constructed from a material having water resistance and thermal insulation sufficient for use in snow conditions.

DETAILED DESCRIPTION OF THE INVENTION

Figure 1:
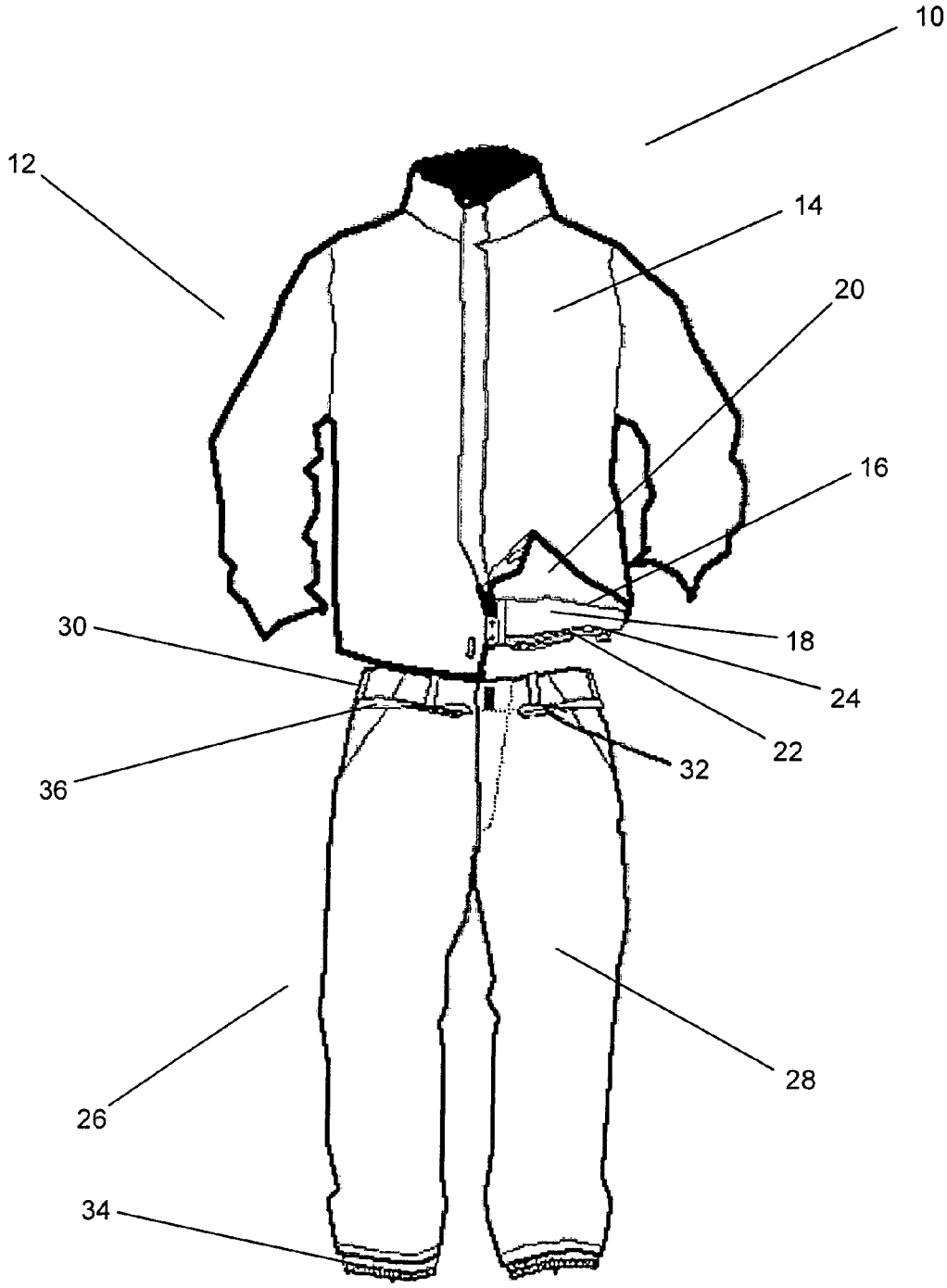
FIG. 1 is a front schematic view of a jacket and trousers in accordance with the present invention, where the jacket includes a powder skirt possessing a mating portion of a zipper and the trousers include a corresponding mating portion of the zipper.

Turning to the figures, a garment set 10 is illustrated that includes a water resistant jacket 12 and pair of trousers 26 that are capable of keeping a wearer warm and dry in hospitable snow conditions. The jacket includes a powder skirt 18 that can be fastened to the trousers. In one embodiment the powder skirt includes a mating portion of a zipper 22 as a fastener, and the trousers include the corresponding mating portion of the zipper 32 as a fastener. When the garment set is worn and the powder skirt is fastened to the trousers, the powder skirt extends from the exterior of the trousers 28 to the interior 20 of the jacket, which seals an opening between the jacket and the trousers that would otherwise exist. By sealing the opening, the powder skirt can create a barrier to rain and snow that remains intact during a fall by the wearer. In some instances, the mating zipper portions conform to predetermined specifications so that the zipper portions can be combined irrespective of the size of the jacket and trousers that form the garment set. In addition, the trousers can also include a welt flap 36 over the corresponding mating portion of the zipper to prevent injury when the corresponding mating portion of the zipper is unattached.

A garment set in accordance with the present invention is illustrated in FIG. 1. The garment set 10 includes a jacket 12. The exterior of the jacket 14 is constructed from a water resistant material. One edge 16 of a powder skirt 18 is attached to the interior surface 20 of the jacket. The powder skirt extends some distance from the interior surface of the jacket and a mating portion of a zipper 22 is connected to the other edge 24 of the powder skirt. The garment set 10 also includes trousers 26. The exterior 28 of the trousers is also constructed from a water resistant material. Attached near the waist 30 of the trousers is a corresponding mating portion of a zipper 32 that is designed to be combined with the mating portion of the zipper 22 connected to the powder skirt 18.

Typically the powder skirt 18 is constructed from a water resistant material that can be elasticized. In several instances, the powder skirt is sewn to the interior surface of the jacket although in other cases the powder skirt can be attached via a zipper, buttons, a hook and loop fastening material or other attachment means. In addition, the powder skirt may be attached to the bottom edge of the jacket, be integrated into the bottom of the jacket or attached to the outside of the jacket. In embodiments where the jacket includes a front zipper to facilitate entry of the jacket, a gap in the powder skirt is required. When worn, the gap can be closed by attaching a portion of the powder skirt on either side of the gap to either a portion of the jacket on the other side of the gap and/or to a portion of the powder skirt on the other side of the gap. Attachment can be achieved using buttons, press studs, a zipper or a hook and loop fastening material.

The trousers 26 typically include a method of fitting the waist 30 of the trousers to the waist of the person wearing the trousers. When fitted, the waist 30 of the trousers 26 can prevent the trousers from falling down. In some examples of the invention, a bib and brace or suspenders are used to prevent the trousers from falling down. The trousers can also include powder skirts 34 inside the openings of each leg. As can be seen in the embodiments illustrated in FIGS. 1, 3, 4 and 5, the powder skirts 34 are contained at least partially within one of the trouser leg openings. In some instances of the invention, the corresponding mating portion of the zipper is at least partially concealed below a welt flap 36 to prevent the teeth of the zipper portion from causing injury when the corresponding mating portion is unattached.

Figure 2:
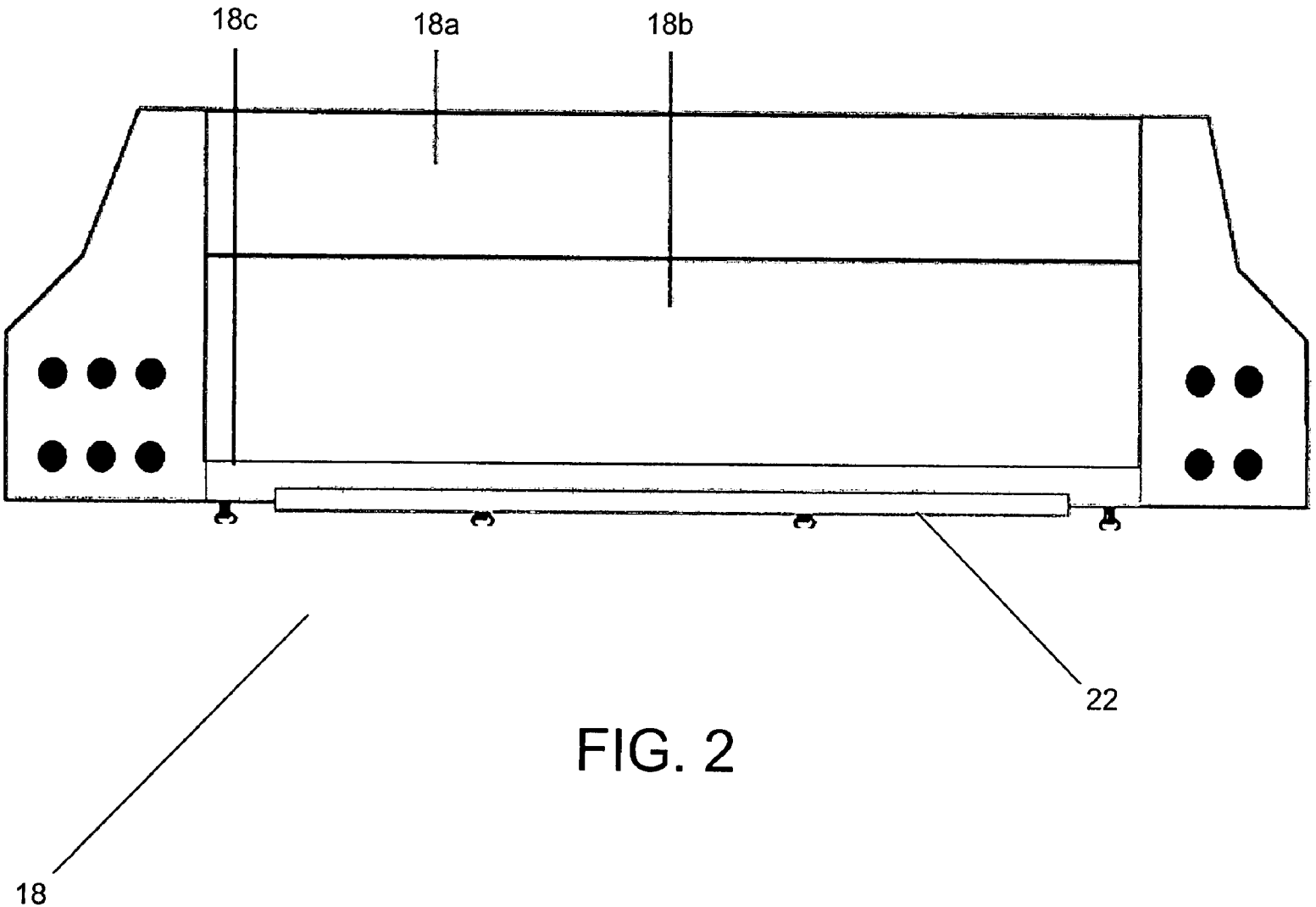
FIG. 2 is a schematic view of materials that can be used in the construction of a powder skirt in accordance with the present invention.

An embodiment of a powder skirt in accordance with the present invention is illustrated in FIG. 2. The powder skirt 18 is constructed using a Nylon Spandex Knit Stretch Panel 18*a* sewn above a Nylon Tafetta Panel 18*b* and Rubberized Elastic 18*c* is sewn at the bottom hem of the Nylon Tafetta Panel. In this configuration, the powder skirt includes an elastic panel attached to a panel of water resistant material. The elasticized panel forms the upper edge of the powder skirt. As can be seen in the embodiment illustrated in FIG. 2, the panel of water resistant material is attached to the elasticized panel along a seam that is located between the elasticized panel and the lower edge of the powder skirt. The Rubberized Elastic 18*c*, mentioned above, is a rubberized elastic panel attached to the water resistant material along a seam that is located between the elasticized panel and the lower edge of the powder skirt. The mating portion of a zipper 22 is attached to the rubberized elastic panel. In one embodiment, the mating portion of the zipper 22 and the corresponding mating portion of the zipper 32 are constructed using a YKK #5 Coil Separating Zipper. The powder skirt 18 shown in FIG. 2 includes an upper edge and a lower edge. As can be seen in FIG. 2, the upper edge and the lower edge are substantially parallel and the lower edge of the powder skirt is longer than the upper edge of the powder skirt.

Although in other embodiments, variations in the number of panels and other combinations of elasticized and non-elasticized materials can be used in the construction of the powder skirt 18 and other zippers can be used in the construction of the mating portion of the zipper 22 and the corresponding mating portion of the zipper 32.

Figure 3:
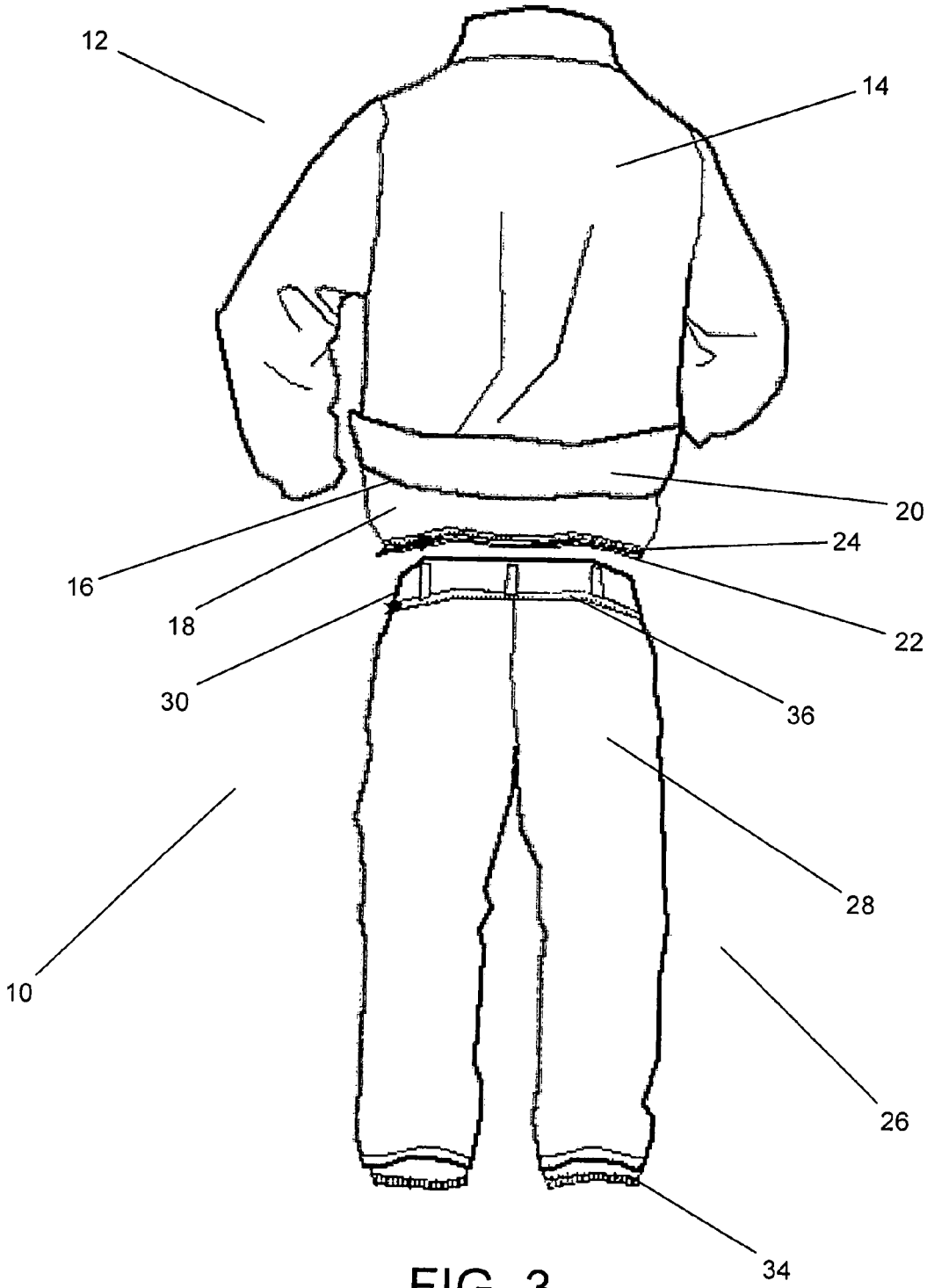
FIG. 3 is a rear schematic view of a jacket and trousers in accordance with the present invention.

A rear view of the garment set 10 is shown in FIG. 3. The jacket 12 is raised to reveal the powder skirt 18 attached to the interior 20 of the jacket. The corresponding mating portion of the zipper 32 is completely concealed beneath the welt flap 36.

Figure 4:
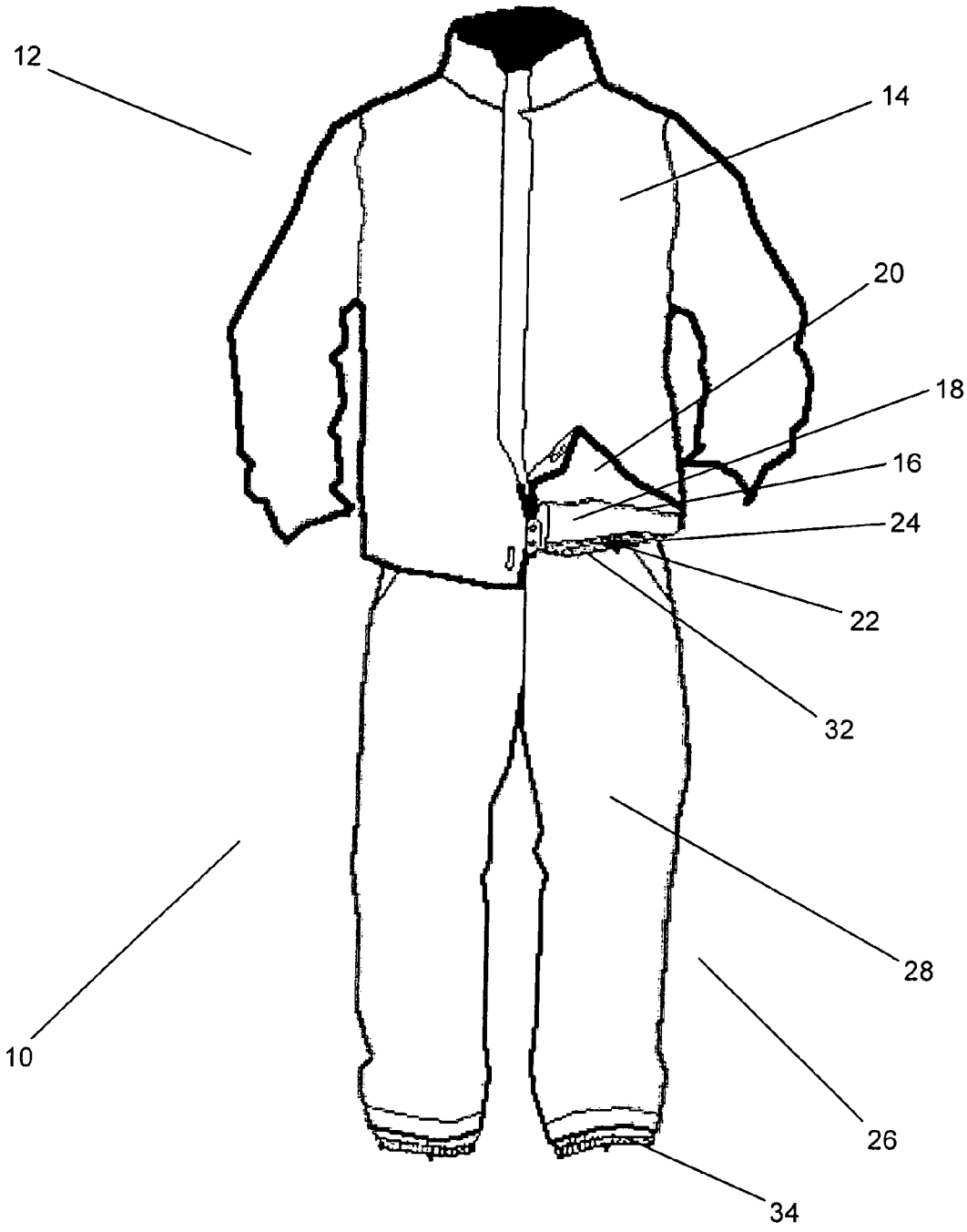
FIG. 4 is a front schematic view of the jacket and trousers in accordance with the present invention, where a portion of the jacket is raised to reveal the attachment in accordance with the present invention of the mating portion of a zipper on the powder skirt to the corresponding mating portion of a zipper on the trousers.

A front view of the garment set 10, where the powder skirt is attached to trousers in accordance with the present invention, is shown in FIG. 4. The powder skirt 18 of a jacket 12 is attached to trousers 26 by combining the mating portion of the zipper 22 with the corresponding mating portion of the zipper 32. In embodiments where the powder skirt includes a band of elasticized material, some travel is accommodated to enable the jacket and the trousers an extent of independent movement. In embodiments that do not include elasticized material, upward movement of the jacket can cause the trousers to ride up in an uncomfortable manner. Typically, sufficient elastic travel is provided to minimize the extent to which the jacket can cause the trousers to ride up during activity or during a fall.

Figure 5:
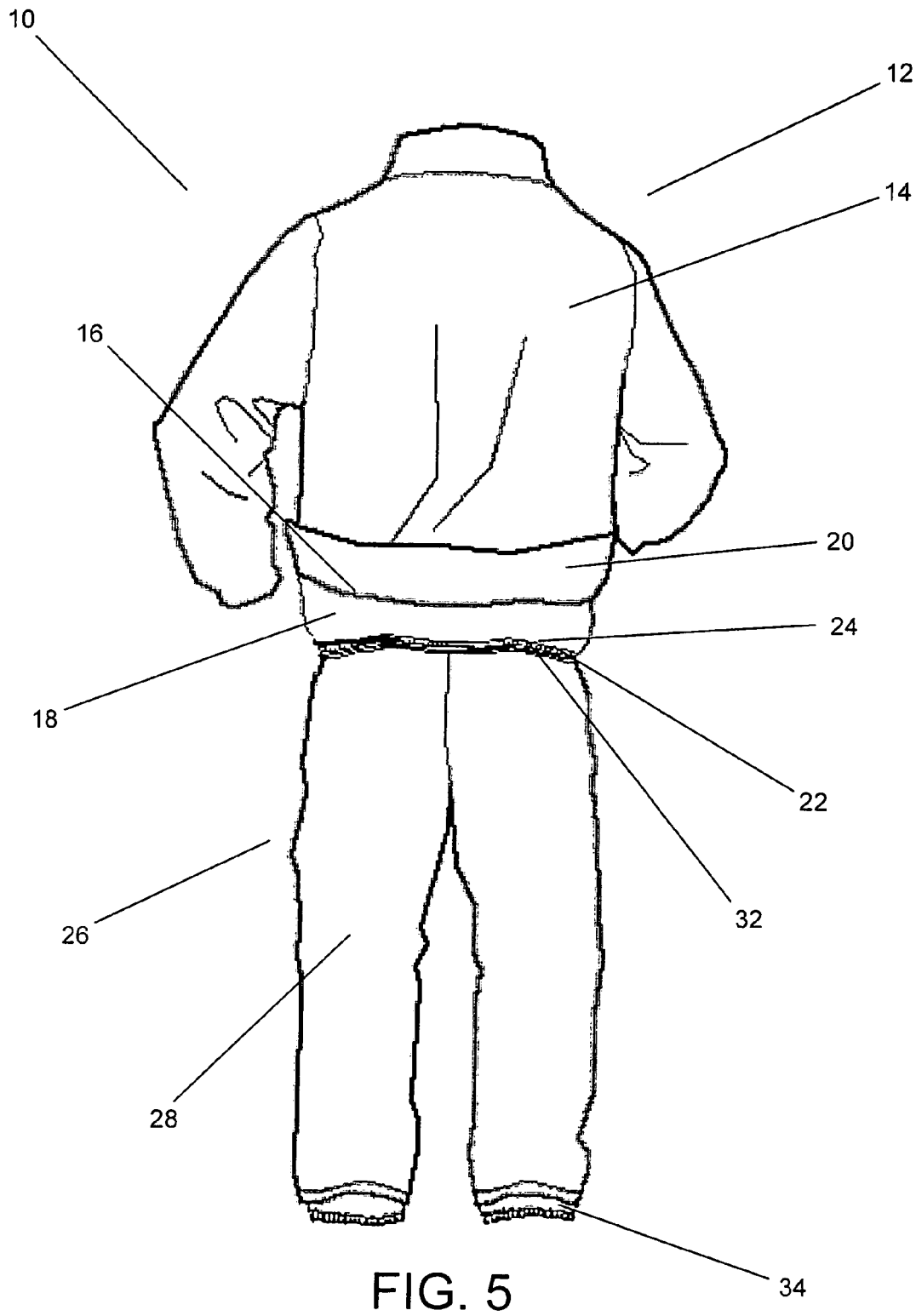
FIG. 5 is a rear schematic view that shows a jacket and trousers in accordance with the present invention, where the jacket is raised to reveal the attachment in accordance with the present invention of the mating portion of the zipper on the powder skirt to the corresponding mating portion of the zipper on the trousers.

A rear view of the garment set 10, where the powder skirt is attached to trousers in accordance with the present invention, is shown in FIG. 5. When the zipper portions are combined, the welt flap is concealed inside the powder skirt.

In some examples of the invention, standard mating portions of zippers and corresponding mating portions of zippers are used in the construction of jackets and trousers in accordance with the present invention. Providing a selection of different sized jackets and trousers can enable individuals to choose a garment set that is most appropriate for their body shape. The use of standardized zipper portions ensures that, irrespective of the size of jacket and trousers chosen, the powder skirt of the jacket can be attached to the trousers using the zipper portions. In addition, a person may combine various jackets of the same size with a particular pair of trousers and vice versa.

Although the foregoing embodiments are disclosed as typical, it would be understood that additional variations, substitutions and modifications can be made to the system, as disclosed, without departing from the scope of the invention. For example, press studs, hook and loop fastening materials, buttons, permanent attachment such as stitching, or any other fasteners could be used to secure a powder skirt to a pair of trousers in accordance with the present invention. In addition, other configurations of the invention can include a powder skirt attached to trousers that is attachable to a jacket or another powder skirt attached to a jacket. Accordingly, the scope of the invention should be determined not by the embodiments illustrated, but by the appended claims and their equivalents.

What is claimed is:

1. A winter sport garment set, comprising:

a water resistant jacket;

an elasticized powder skirt having an upper edge and a lower edge, the upper edge of which is stitched to the water resistant jacket;

a first mating portion of a zipper connected to the lower edge of the powder skirt;

water resistant trousers including a waist opening and two leg openings; and a first corresponding mating portion of a zipper connected to the trousers;

wherein the fastener and the corresponding mating portions of a zipper are constructed to detachably fix the powder skirt to the water resistant trousers;

wherein the water resistant trousers include two powder skirts, each powder skirt is attached to the interior surface of the trousers and each powder skirt is contained at least partially within one of the trouser leg openings;

wherein the elasticized powder skirt comprises an elasticized panel attached to a panel of water resistant material; and wherein an edge of the elasticized panel forms the upper edge of the elasticized powder skirt.

2. The garment set of claim 1, wherein the water resistant jacket includes an interior surface and an exterior surface; and the upper edge of the powder skirt is stitched to the interior surface of the jacket.

3. The garment set of claim 2, wherein:

the water resistant trousers include an interior surface and an exterior surface; and the first corresponding mating portion of a zipper is attached to the exterior surface of the trousers.

4. The garment set of claim 3, wherein the trousers further comprise a welt flap having a first edge that is fixed to the exterior surface of the trousers between the first corresponding mating portion of a zipper and the waist opening, where the welt flap at least partially conceals the first corresponding mating portion of a zipper.

5. The garment set of claim 1, wherein the water resistant jacket and water resistant trousers are constructed from materials having water resistance and thermal insulation sufficient to perform activity in snow conditions.

6. The garment set of claim 1, wherein the upper edge of the powder skirt is substantially parallel to the lower edge of the powder skirt.

7. The garment set of claim 6, wherein the lower edge of the powder skirt is longer than the upper edge of the powder skirt.

8. The garment set of claim 7, wherein the length of the first mating portion of a zipper is shorter than the length of the lower edge of the elasticized powder skirt.

9. The garment set of claim 1, wherein the powder skirt comprises:

an elasticized panel proximate the upper edge of the powder skirt;

the panel of water resistant material is attached to the elasticized panel along a seam that is located between the elasticized panel and the lower edge of the powder skirt; and a rubberized elastic panel is attached to the water resistant material along a seam that is located between the elasticized panel and the lower edge of the powder skirt.

10. The garment set of claim 9, wherein the first mating portion of a zipper is attached to the rubberized elastic panel.

11. The garment set of claim 1, wherein the first mating and corresponding mating portions of a zipper are standardized so that, irrespective of the size of the jacket and the size of the trousers, the powder skirt of the jacket can be attached to the trousers.

* * * * *

UNITED STATES PATENT AND TRADEMARK OFFICE

CERTIFICATE OF CORRECTION

PATENT NO. : 7,404,214 B2
APPLICATION NO. : 10/984074
DATED : July 29, 2008
INVENTOR(S) : Richard Woolcott et al.

It is certified that error appears in the above-identified patent and that said Letters Patent is hereby corrected as shown below:

In column 5, lines 31-33, in Claim 1, delete "wherein the fastener and the corresponding mating portions of a zipper are constructed to detachably fix the powder skirt to the water resistant trousers;" and insert -- wherein the first mating and the corresponding mating portions of a zipper are constructed to detachably fix the powder skirt to the water resistant trousers; --

Signed and Sealed this
Twenty-fourth Day of July, 2012

David J. Kappos

David J. Kappos
*Director of the United States Patent and Trademark Office*